United States Patent [19]

Quayle

[11] 4,241,459

[45] Dec. 30, 1980

[54] VEST FOR PHOTOGRAPHERS

[76] Inventor: Stephen R. Quayle, P.O. Box 99, Bozeman, Mont. 59715

[21] Appl. No.: 7,932

[22] Filed: Jan. 26, 1979

[51] Int. Cl.[2] ..... A41D 1/04

[52] U.S. Cl. ..... 2/102

[58] Field of Search ..... 2/102, 94, 73 LG; 224/5 V, 5 K, 8 R

[56] References Cited

U.S. PATENT DOCUMENTS

| | | | |
|---|---|---|---|
| 1,352,453 | 9/1920 | Jennings | 224/224 |
| 1,486,676 | 3/1924 | Nilssen | 2/102 |
| 3,266,070 | 8/1966 | O'Link | 2/102 X |
| 3,782,614 | 1/1974 | Campisi | 224/909 |
| 4,055,873 | 11/1977 | Kallman | 2/DIG. 6 |
| 4,106,121 | 8/1978 | Belson | 2/102 |

*Primary Examiner*—Doris L. Troutman

*Attorney, Agent, or Firm*—Clarence A. O'Brien; Harvey B. Jacobson

[57] ABSTRACT

A vest-type garment is provided including right and left front panels removably securable together by a slide fastener. The opposite side portions of the vest defining those portions which extend over the shoulders of the wearer included elongated transverse strips of a first "VELCRO" material secured thereto and second strips of a second "VELCRO" material have one pair of ends thereof anchored relative to a corresponding pair of ends of the first mentioned strips and the second strips may be positioned in overlying relation to and releasably engaged with the first strips, over equipment bag straps disposed between the superposed strips. The front panels of the garment have outstanding upwardly opening lower waist and upper chest pockets secured thereto and the walls of the lower pockets are padded and each lower pocket includes a central upstanding padded partition therein extending between the inner and outer walls of the pocket, secured one of the inner and outer walls and releasably secured to the other of the corresponding inner and outer walls.

9 Claims, 6 Drawing Figures

4
60
58
22
38
84
40
78
34
18
124
72
68
3
80
24
10
42
36
30
32
20
70

60
38
14
58
12
40
42
48
54
28
26
72
52
68
50
16

74
68
102
100
106
46
96
104
90
110
108
112
92
Expanded
86
94

VEST FOR PHOTOGRAPHERS

BACKGROUND OF THE INVENTION

Various forms of jackets and vests have been provided with various forms of compartments therein for containing and supporting different types of equipment. Some of these jackets and/or vests have been specifically designed for hunters, carpenters and fishermen, but few have been specifically designed for use by the serious photographer, notwithstanding the fact that a serious photographer often is required to carry a considerably large number of individual equipment and accessory pieces than either a hunter, a carpenter or a fisherman. Accordingly, a need exists for a vest-type structure specifically adapted to contain and protectively support various different forms of photographic equipment.

Examples of various forms of vests and jackets previously provided for use by photographers, fishermen, carpenters and hunters are disclosed in U.S. Pat. Nos. 1,486,676, 2,066,072, 2,448,499, 2,678,447 and 2,919,443.

BRIEF DESCRIPTION OF THE INVENTION

The vest of the instant invention is of durable construction and includes right and left front panels each having outstanding lower waist and upper chest pockets secured thereto. In addition, those portions of the front panels of the vest disposed intermediate corresponding upper and lower panels are of double thickness and provided slide fastener closable pocket slits. The upper front panel pockets are provided with slide fastener closable closure flaps and the lower front panel pockets are provided with downwardly opening flaps which may be removably secured in the closed positions by "VELCRO" fasteners. In addition, the interiors of the lower front pockets include front to rear extending partitions with the partitions fixedly secured to one of the front and rear walls of the pockets and removably secured to the other of the front and rear walls of the pockets by "VELCRO" fastener structure.

The upper surfaces of the shoulder portions of the vest include first transverse "VELCRO" strips secured thereto and second "VELCRO" strips are anchored relative to the corresponding ends thereof and positionable over and releasably engageable with the first mentioned "VELCRO" strips, whereby accessory bag straps may be releasably secured in position over the shoulder portions of the vest.

The main object of this invention is to provide a vest for use by photographers including various compartments therein in which different types of photographic equipment and accessories may be protectively contained and supported.

Another object of this invention is to provide a compartmented vest including at least some compartment defining portions thereof which are substantially fully padded.

Another object of this invention is to provide a compartmented vest constructed in a manner whereby various compartments thereof may be releasably closed and yet constructed in a manner whereby access thereto may be readily gained.

A further object of this invention is to provide a photographic accessory and equipment supporting and protective garment of durable construction and which is substantially waterproof and may therefore protect the photographic equipment and accessories supported therein from the elements.

A final object of this invention to be specifically enumerated herein is to provide a photographic equipment supportive garment for use by photographers and which will conform to conventional forms of manufacture, be of simple construction and easy to use so as to provide a device which will be economically feasible, long lasting and trouble free in operation.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
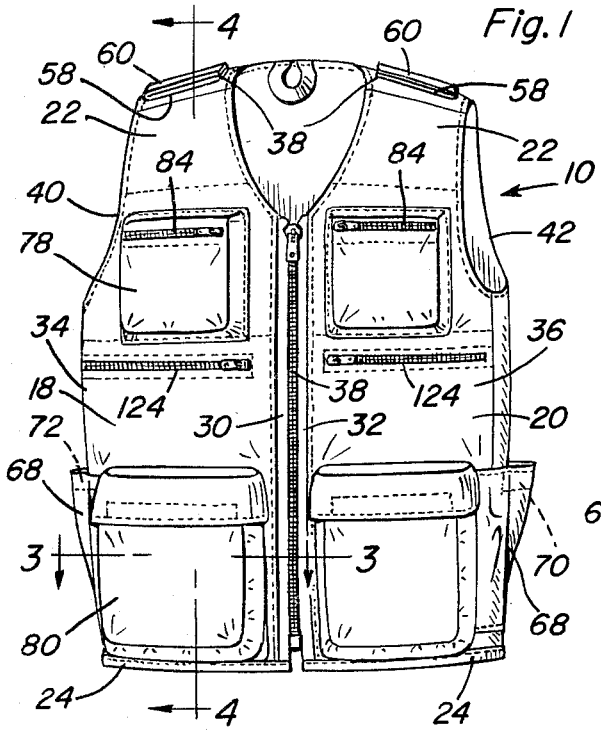
FIG. 1 is a front elevational view of the vest.
Figure 2:
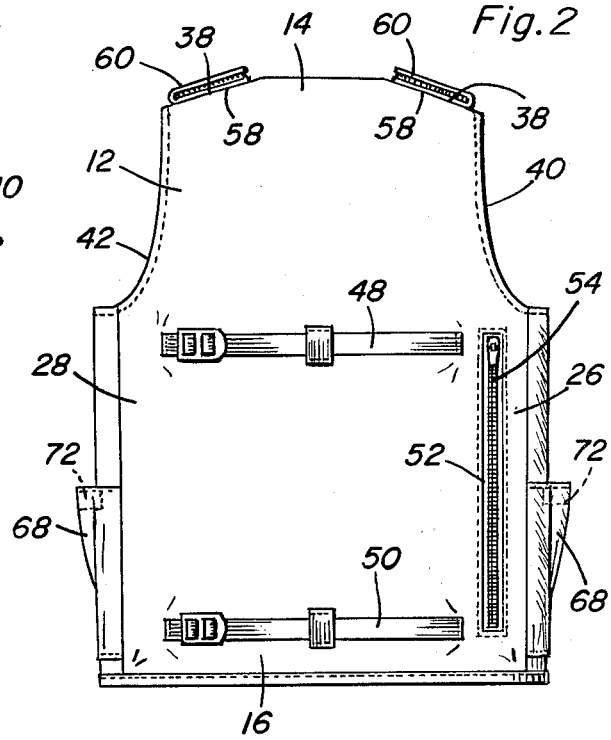
FIG. 2 is a rear elevational view of the vest.
Figure 3:
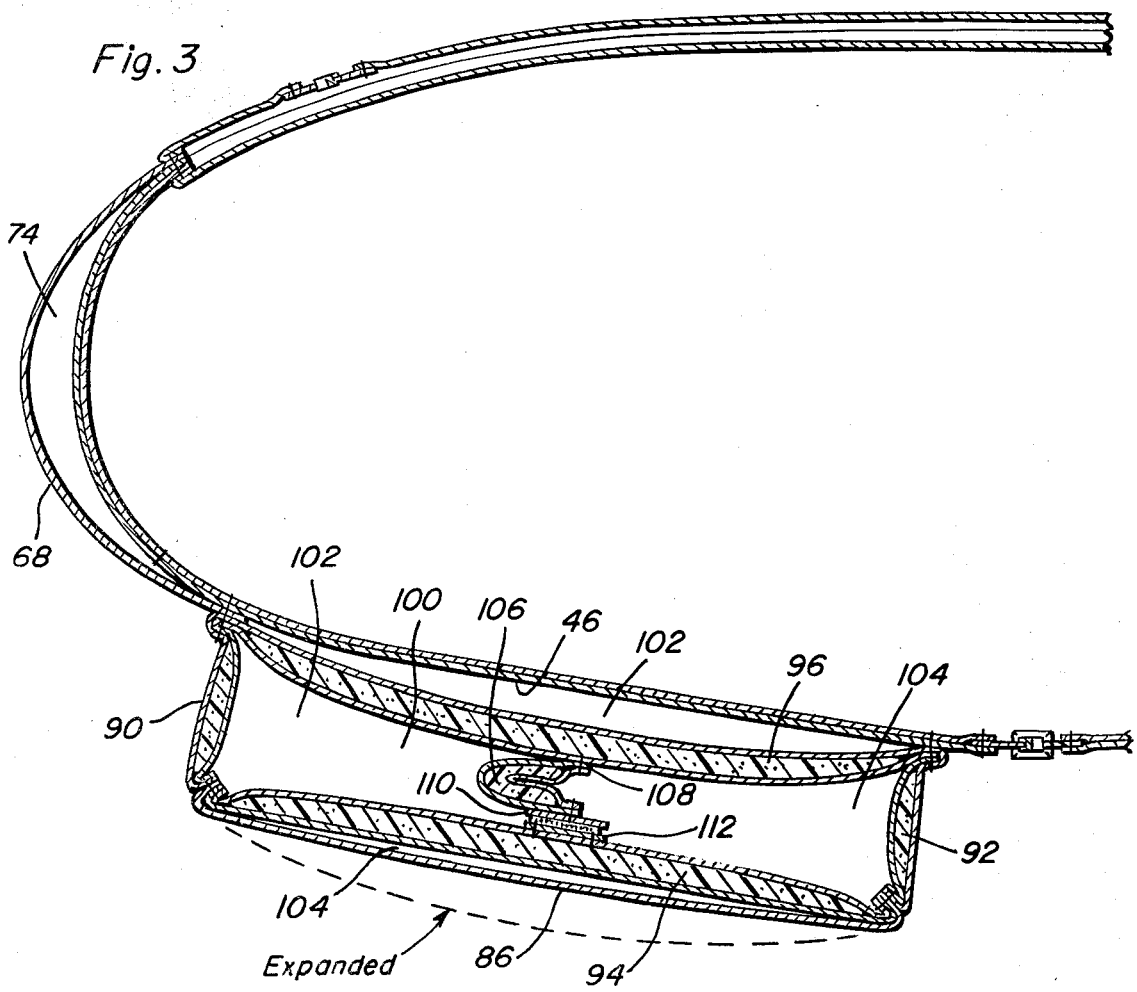
FIG. 3 is an enlarged fragmentary horizontal sectional view taken substantially upon the plane indicated by the section line 3—3 of FIG. 1.
Figure 4:
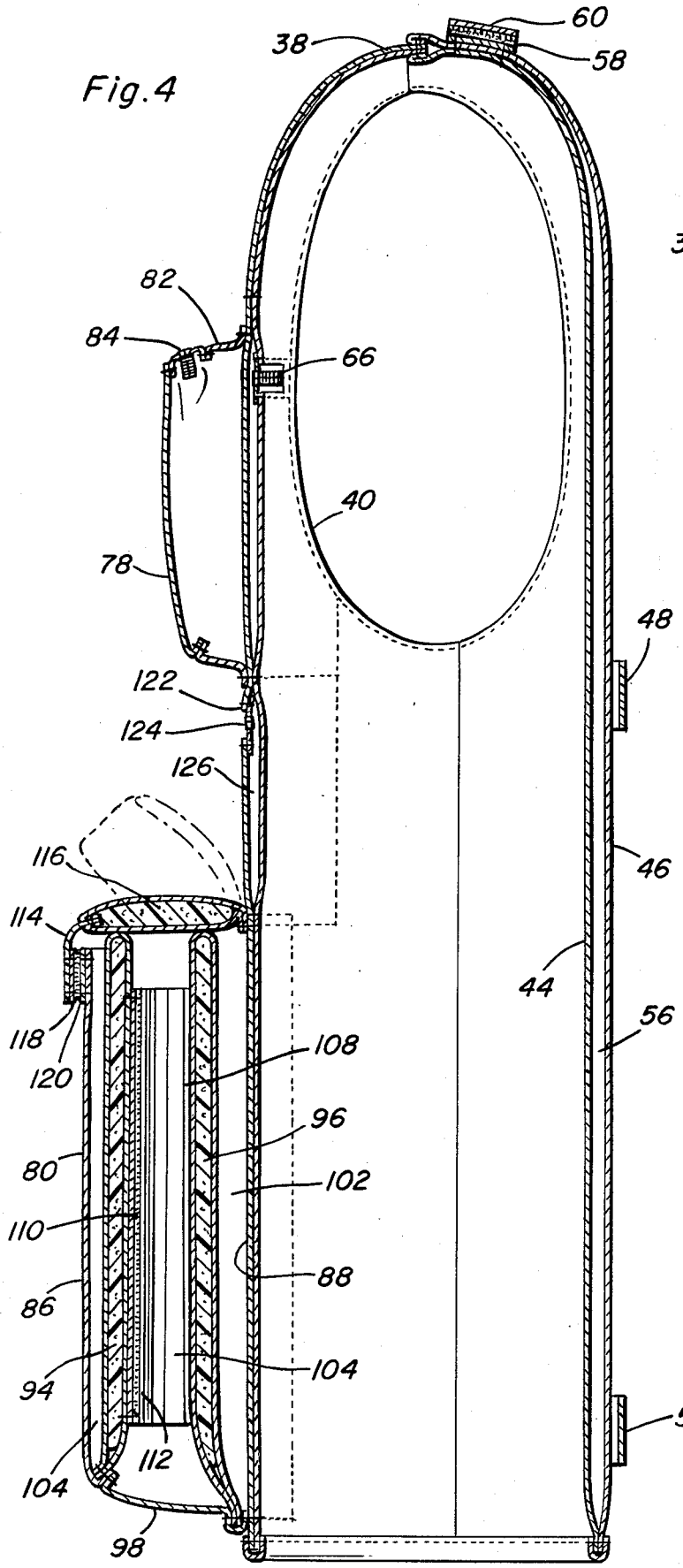
FIG. 4 is an enlarged vertical sectional view taken substantially upon the plane indicated by the section line 4—4 of FIG. 3.
Figure 5:
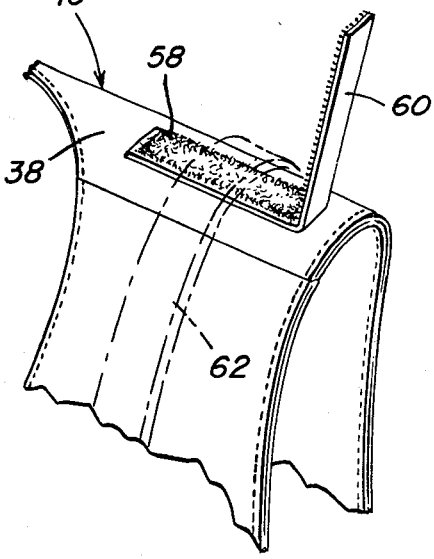
FIG. 5 is an enlarged fragmentary perspective view of one of the shoulder portions of the vest illustrating the accessory bag strap retaining structure thereof.

Referring now more specifically to the drawings, the numeral 10 generally designates the vest of the instant invention. The vest 10 is constructed of a strong flexible material such as nylon which is tightly woven in order to afford reasonable waterproofing. The vest 10 includes a back panel 12 having upper and lower marginal portions 14 and 16 and a pair of right and left front panels 18 and 20 each including upper and lower marginal portions 22 and 24. The back panel 20 includes opposite side marginal portions 26 and 28 and the front panels 18 and 20 include adjacent marginal portions 30 and 32 and remote marginal portions 34 and 36.

The adjacent marginal portions 30 and 32 are removably secured together by a slide fastener construction 38 and the upper marginal portions 22 of the front panels 18 and 20 are secured to the opposite side portions of the upper marginal portion 14 of the back panel 12 in order to define shoulder portions 38 for overlying the shoulders of the wearer.

The front panel remote marginal portions 34 and 36 are secured to the side marginal portions 26 and 28 of the back panel 12 and the vest 10 defines arm openings 40 and 42 between the upper portions of the marginal portions 26 and 28 and the marginal portions 34 and 36.

The vest 10 is constructed, throughout, to include inner and outer panels 44 and 46 and the upper and lower portions of the outer panel 46 defining the back panel 12 include adjustable length horizontal transverse straps 48 and 50 whereby the vest may be adjusted according to the size of the wearer. In addition, the right-hand side of the outer panel 46 in the area of the back panel 12 includes a slit 52 removably closable by a slide fastener 54 whereby a large rear pocket 56 is defined within the back panel 12 and to which access may be had by the wearer of the vest 10 through the utilization of his right arm and hand.

The shoulder portions 38 each have a strip 58 of a first "VELCRO" material secured thereto and a second strip 60 of a second "VELCRO" material is secured to the outer ends of each of the strips 58 and each strip 60 is positionable in overlying relation to the corresponding strip 58 and removably securable thereto in a manner which is well known. However, the shoulder strap 62 of an accessory bag (not shown) may be placed over either strip 58 before securement of the strip 60 thereover in order that the shoulder strap 62 may be held in position on the corresponding shoulder. It will be noted that the strip 60 is secured to the outer end of the corresponding strip 58, thereby substantially precluding any possibility of the shoulder strap 62 being able to slide from the shoulder portion 38 of the vest 10.

Figure 6:
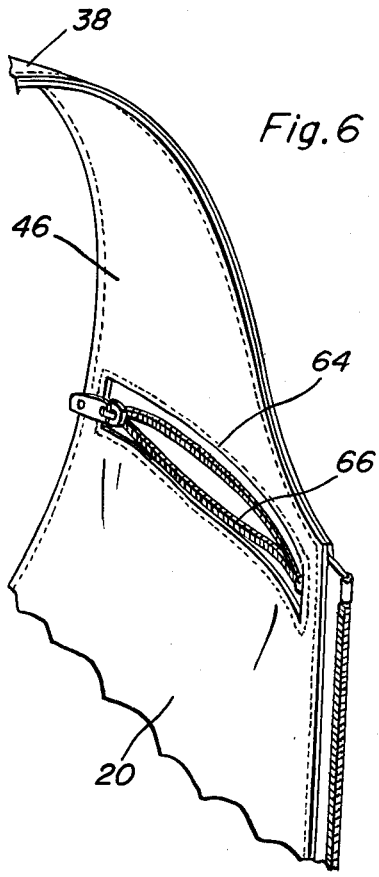
FIG. 6 is a fragmentary perspective view of the inner side of the upper portion of the left front panel of the vest.

The upper portion of the inner panel 40 of each front panel 28 and 30 includes a pocket forming slit 64 formed therein removably closed by means of a slide fastener 66 (see FIG. 6) and each opposite side lower portion of the vest 10 includes an additional gathered panel 68 secured thereover and equipped with coacting "VELCRO" strips 70 and 72. The panels 68 define upwardly opening pockets 74 spaced below the arm openings 40 and 42 and the pockets are removable closable by means of the "VELCRO" strips 70 and 72 removably anchorable to each other in order to "pinch" the pockets 74 closed.

The outer panel portions of front panels 18 and 20 have upper and lower outstanding pocket defining structures 78 and 80 secured thereto and the pocket defining structures 78 include closure flaps 82 which may be secured in the closed positions by means of slide fasteners 84. The pocket defining structures 80 include outer walls 86, inner walls 88 defined by the outer panel 46 and opposite side walls 90 and 92 which are padded. Further, the pocket defining structures include padded inner and outer walls 94 and padded outer inner walls 96 extending between the side walls 90 and 92. Also, the pocket defining structures 80 include bottom walls 98 to which the lower portions of the walls 90, 92, 94 and 96 are secured. Accordingly, a major padded pocket area 100 is defined between the walls 94 and 96 and the walls 90 and 92, an inner pocket compartment 102 is defined between the outer inner wall 96 and the outer panel 46 and an outer pocket compartment 104 is defined between the outer wall 86 and the inner outer wall 94. Further, the major pocket area 100 is divided into separate compartment sections 102 and 104 by a padded partition 106 permanently secured to the outer inner wall 96 by stitching 108 intermediate the side walls 90 and 92 and releasably secured to the inner outer wall 94 by means of "VELCRO" strips 110 and 112 secured to the partition 106 and to the inner surface of the inner outer wall 94.

The pocket defining structures 80 include downwardly opening closure flaps 114 including padded upper wall portions 116 and the closure flaps are removably securable over the open upper portions of the pocket defining structure 80 and to the outer upper surface portions of the outer wall 86 by means of "VELCRO" strips 118 and 120 secured to the flap 114 and outer wall 86.

It will also be noted that the pocket defining structures 78 and 80 on each front panel 18 and 20 are vertically spaced apart and that the upper portion of the outer panel 46 disposed between the upper and lower pocket defining structures includes a pocket entrance slit 122 removably closable by means of a slide fastener 124.

As hereinbefore set forth, the vest 10 may be adjusted by means of the adjustable length straps 48 and 50 according to the size of the wearer of the vest 10 and the numerous pockets defined by the vest may be utilized to contain and protectively support various forms of camera equipment and accessories. For example, the rear pocket 56 may be utilized to contain a large number of rolls of film for film packs. The large lower front pocket defining structures may be utilized to hold two or more telephoto lenses or camera bodies per pocket, the pockets 74 may be utilized to protectively support quick change lenses and other miscellaneous items, the pockets 126 to which access may be had through the slits 122 may contain numerous rolls of film, the pocket defining structures 78 may be utilized to, contain various meters, small lenses and various camera accessories and the inner pockets to which access may be had through the slits 64 may be utilized to contain various forms of other photography related materials.

The more important features of the vest 10 include the strips 58 and 60 and the pocket defining structures 78 and 86. The importance of the padded walls 90, 92, 94 and 96 as well as the padded partitions 106 is also stressed.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A garment for use by photographers to contain and protectively support photographic equipment including cameras, lenses, film and film packs, filters and meters, etc., said garment including a front opening body having a back panel defining upper, lower and opposite right and left side marginal portions and a pair of right and left side front panels defining upper, lower and adjacent inner and remote outer side marginal portions, the upper marginal portions of said front panels and the right and left hand portions of the upper marginal portions of said back panel being joined together to define right and left shoulder covering portions of said garment, the lower end portions of said remote outer side marginal portions being joined to the lower end portions of the said right and left side marginal portions of said back panel, said front panels including fabric pocket defining means secured thereto defining upwardly opening upper chest and lower waist pockets on the exterior of each of said front panels, the upper remote outer side marginal portions of said front panels and the upper portions of the corresponding side marginal portions of said back panel being spaced apart and defining upper arm openings therebetween below said shoulder covering portions, each lower pocket fabric pocket defining means defining inner, outer, bottom and opposite side walls disposed forwardly of the corresponding front panel, each lower pocket fabric defining means also defining an upstanding partition generally paralleling the corresponding side walls, extending between the corresponding inner and outer walls intermediate the side walls, permanently anchored relative to one of the corresponding inner and outer walls and releasably secured to the other of said corresponding inner and outer walls.

2. The combination of claim 1 wherein the upper and lower pockets on the exteriors of said front panels are vertically spaced, said front panels, intermediate corresponding upper and lower pockets being double fabric panel thickness including inner and outer panels, and generally horizontal slits formed in said outer panels adjacent said upper pocket, and slide fastener means removably closing said slits.

3. The combination of claim 1 wherein said upper pocket fabric pocket defining means includes slide fastener closable flap portions.

4. The combination of claim 1 wherein said lower pocket fabric pocket defining means includes means defining padded wall portions for front, rear and opposite side wall portions of the said waist pockets.

5. The combination of claim 4 wherein said lower pocket fabric pocket defining means includes downwardly opening pocket flap structure removably securable in closed positions by cooperating first and second fabric fastener means.

6. The combination of claim 5 wherein the upper surface of at least one of said shoulder covering portions includes a first elongated strip portion of a first fabric fastening material secured thereto and extending transversely thereof, and a second elongated strip portion of a second fabric fastening material anchored at one end to a corresponding end of said first strip portion and positionable over and releasably engageable with said first strip portions.

7. A garment for use by photograhers to contain and protectively support photographic equipment including cameras, lenses, film and film packs, filters and meters, etc., said garment including a front opening body having a back panel defining upper, lower and opposite right and left side marginal portions and a pair of right and left side front panels defining upper, lower and adjacent inner and remote outer side marginal portions, the upper marginal portions of said front panels and the right and left hand portions of the upper marginal portions of said back panel being joined together to define right and left shoulder covering portions of said garment, the lower end portions of said remote outer side marginal portions being joined to the lower end portions of the said right and left side marginal portions of said back panel, said front panels including fabric pocket defining means secured thereto defining an upwardly opening lower waist pocket on the exterior of each of said front panels, the upper remote outer side marginal portions of said front panels and the upper portions of the corresponding side marginal portions of said back panel being spaced apart and defining upper arm openings therebetween below said shoulder covering portions, each lower pocket fabric pocket defining means defining inner, outer, bottom and opposite side walls disposed forwardly of the corresponding front panel, each lower pocket fabric defining means also defining an upstanding partition generally paralleling the corresponding side walls, extending between the corresponding inner and outer walls intermediate the side walls, permanently anchored relative to one of the corresponding inner and outer walls and releasably secured to the other of said corresponding inner and outer walls.

8. The combination of claim 7 wherein said lower pocket fabric pocket defining means includes means defining padded wall portions for front, rear and opposite side wall portions of the said waist pockets.

9. The combination of claim 8 wherein said upstanding partition comprises a multiply padded partition.

* * * * *